US009849371B1

(12) United States Patent
Grahl

(10) Patent No.: US 9,849,371 B1
(45) Date of Patent: Dec. 26, 2017

(54) SCRATCHING DEVICE WITH INTEGRATED LIGHT

(71) Applicant: HT Enterprises, Inc., Campbellsport, WI (US)

(72) Inventor: Kenneth Lee Grahl, Fond du Lac, WI (US)

(73) Assignee: HT Enterprises, Inc., Campbellsport, WI (US)

( * ) Notice: Subject to any disclaimer, the term of this patent is extended or adjusted under 35 U.S.C. 154(b) by 0 days.

(21) Appl. No.: 15/422,071

(22) Filed: Feb. 1, 2017

Related U.S. Application Data

(60) Provisional application No. 62/290,821, filed on Feb. 3, 2016.

(51) Int. Cl.

| | |
|---|---|
| ***A63F 3/06*** | (2006.01) |
| ***B43K 29/06*** | (2006.01) |
| ***B43K 29/10*** | (2006.01) |
| ***B43K 24/00*** | (2006.01) |
| ***B43K 29/00*** | (2006.01) |

(52) U.S. Cl.
CPC ..... *A63F 3/068* (2013.01); *B43K 24/00* (2013.01); *B43K 29/00* (2013.01); *B43K 29/06* (2013.01); *B43K 29/10* (2013.01)

(58) Field of Classification Search
CPC ..... A63F 3/068; B43K 29/06; B43K 29/10
See application file for complete search history.

(56) References Cited

U.S. PATENT DOCUMENTS

| | | | | |
|---|---|---|---|---|
| 4,719,660 | A * | 1/1988 | Hopkins | A47L 1/16 15/105 |
| 4,770,712 | A * | 9/1988 | Hopkins | A47L 1/16 134/6 |
| 5,179,754 | A * | 1/1993 | Stradnick | A47L 13/02 15/105 |
| 5,813,083 | A * | 9/1998 | Gould | A63F 3/068 15/236.01 |
| 8,627,536 | B1 * | 1/2014 | VanDosen | B25F 1/00 15/105.51 |
| 9,751,001 | B1 * | 9/2017 | Vogel | A63F 3/068 |
| 2005/0196224 | A1 * | 9/2005 | Breslin | A63F 3/0625 401/198 |
| 2009/0300921 | A1 * | 12/2009 | Strickman | A63F 3/068 30/169 |
| 2011/0099746 | A1 * | 5/2011 | Brown | A47L 5/24 15/344 |
| 2015/0091251 | A1 * | 4/2015 | Polk | B43K 23/126 273/138.1 |

* cited by examiner

*Primary Examiner* — Randall Chin
(74) *Attorney, Agent, or Firm* — Brannen Law Office, LLC

(57) ABSTRACT

The present invention relates to a scratching device and in particular to a scratching device having an integrated light. The scratching device is a tool having a first end and a second end. A stylus and a retractable writing element can be at the first end of the tool. A scraper is at the second end of the tool. The scraper has first and second sides that can converge to form an edge. The scraper has an interior that encases a light. The light is diffused through the scraper, wherein the edge is illuminated. The first side of the scraper can be concave, and the second side can be convex.

17 Claims, 6 Drawing Sheets

SCRATCHING DEVICE WITH INTEGRATED LIGHT

This patent application claims priority on and the benefit of provisional application 62/290,821 filed Feb. 3, 2016, the entire contents of which are hereby incorporated herein by reference.

BACKGROUND OF THE INVENTION

1. Field of the Invention

The present invention relates to a scratching device and in particular to a scratching device having an integrated light.

2. Description of the Related Art

Scratching devices are used in many situations. One such situation is when a coating is being removed from the surface of an object, such as a scratch off lottery ticket.

One such device is shown in US Publication Number 2009/0300921 by Strickman et al., and is titled Lottery Ticket Scratcher with Light. It shows a combination lottery ticket scratcher and light that can be in the shape of a icon, such as animals, mythological creatures, religious figures, symbols of luck, greed, sports teams, or other interest or affinities, etc. The lighted scratcher optionally has a key chain or other securing attachment and/or a brush, particularly for bearded characters or characters depicted as having many teeth. The light (e.g., one or more LEDs or light bulbs) projects light onto the end or work area of the lottery ticket scratcher. The light can represent a part of the character, such as the eyes, flame of a dragon, etc., can be colored to any color, have multiple colors or time varying colors, or project white or black light, or combinations thereof. The light can be activated by the user via a switch (e.g., push, squeeze, slide, etc.) or activated when the scratching tool is engaged with a surface during a scratching or scraping operation. The icon can symbolize good luck or good fortune, can be symbols of birth years, mascots, religious figures, mythical figures, or nearly an other character of interest to a potential user. The lighted lottery scratcher can be sold in combination with a gift pack of lottery tickets, for example.

While the device shown may work well for its intended purposes, it does not show the present invention.

Thus there exists a need for a scratching device with integrated light that solves these and other problems.

SUMMARY OF THE INVENTION

The present invention relates to a scratching device and in particular to a scratching device having an integrated light. The scratching device is a tool having a first end and a second end. A stylus and a retractable writing element can be at the first end of the tool. A scraper is at the second end of the tool. The scraper has first and second sides that can converge to form an edge. The scraper has an interior that encases a light. The light is diffused through the scraper, wherein the edge is illuminated. The first side of the scraper can be concave, and the second side can be convex.

According to one advantage of the present invention, the tool can have four functions. The tool has two ends. On the first end are a stylus and a retractable writing element. On the second end is a scratcher through which a light can shine.

According to another advantage of the present invention, a LED, a bulb or another type of light emitting device can be housed within or behind a cover that forms the scraper. This advantageously protects the light.

According to a further advantage of the present invention, the light is diffused through the scraper. Hence, the scraper itself becomes illuminated as the light passes through it.

According to another advantages of the present invention, the scraper can have a first side and a second side that converge to form a scraping edge. The first edge can be concave, wherein debris has an area to accumulate as the edge scratched material from the surface.

Related, the light is useful to provide illumination at and through the edge. This allows for light to be directed at the exact location where the scraping action occurs.

According to a further advantage of the present invention, the scraping edge is selectably illuminated and provides light at the desired location regardless of the orientation of the tool relative to the workpiece. This is advantageous as it is accomplished without shadows regardless of the orientation of the tool.

According to a still further advantage of the present invention, the light can pass radially a full 360 degrees through the scraper. This advantageously allows light to be provided in all directions through the scraper to illuminate objects in the vicinity of the scraper. The light is accordingly useful independently from the scraper.

Other advantages, benefits, and features of the present invention will become apparent to those skilled in the art upon reading the detailed description of the invention and studying the drawings.

BRIEF DESCRIPTION OF THE DRAWINGS

FIG. 8 is a view showing the tool of the present invention in use as a scraper with the light emitting device on.

DETAILED DESCRIPTION OF PREFERRED EMBODIMENTS

Figure 1:
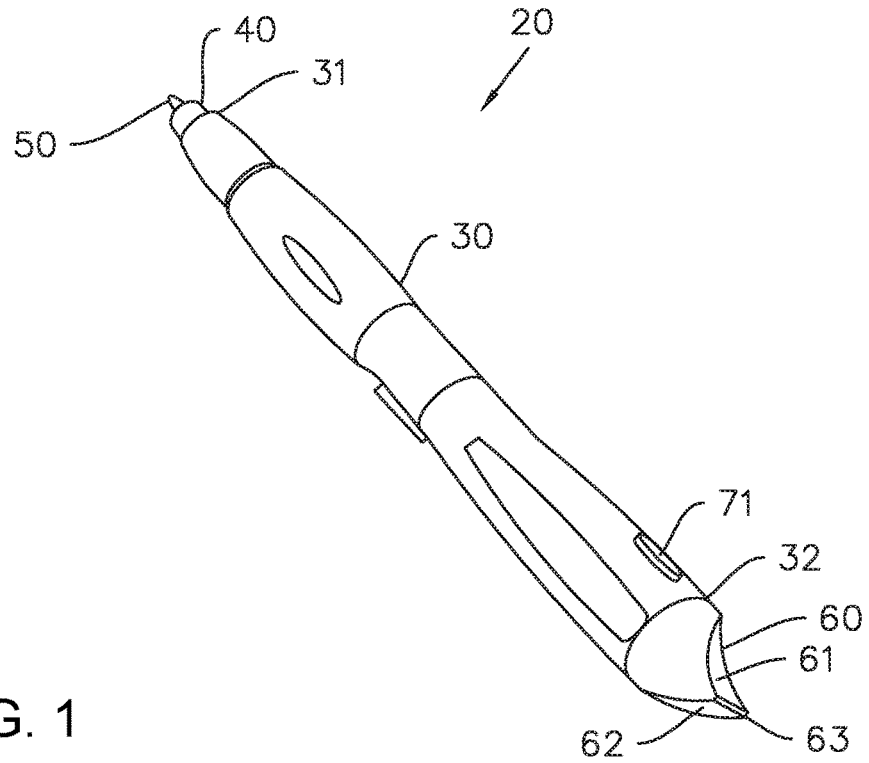
FIG. 1 is a perspective view of an embodiment of the present invention.
Figure 2:
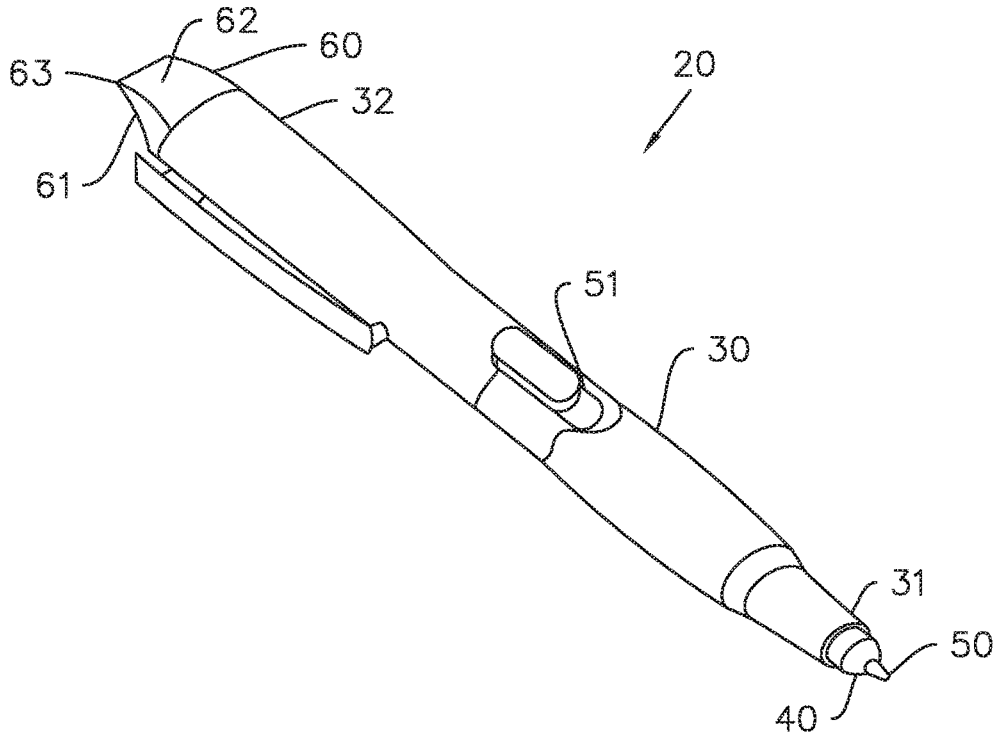
FIG. 2 is a reverse perspective view of the embodiment illustrated in FIG. 1.
Figure 3:
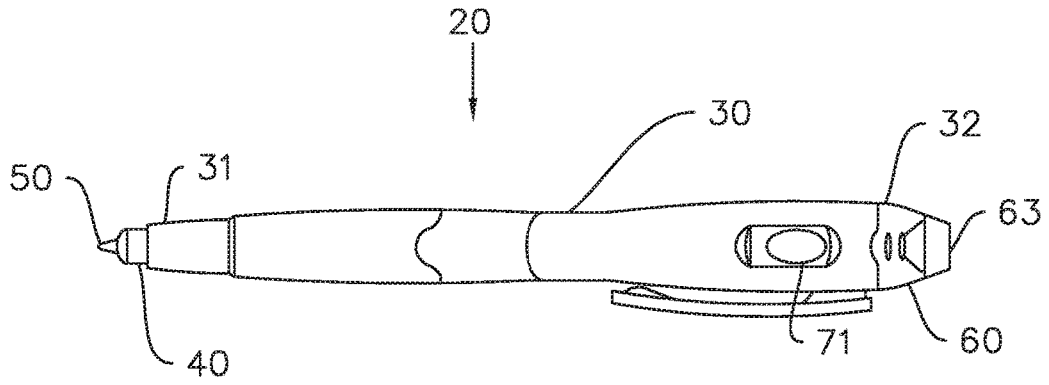
FIG. 3 is a side view of the embodiment illustrated in FIG. 1.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-6, it is seen that a preferred embodiment of the tool 20 of the present invention is illustrated.

The tool 20 has a body 30 with a first end 31 and a second end 32. A stylus 40 is at the first end 31 of the tool. The stylus can be formed of a suitable material useful for use with electronic devices. A pen 50 is also provided at the first end 31. A pen control 51 is provided, and is useful for retracting the tip of the pen 50 into or extending the tip from the end 31 of the body 30. It is appreciated that while a pen is described, that other writing elements (marker, pencil, etc.) may be alternatively provided without departing from the broad aspects of the present invention.

A scraper 60 is at the second end 32 of the body. The scraper 60 has a first side 61 and a second side 62 that converge at an edge 63. The first side 61 of the scraper is preferably generally concave. The second side 62 of the scraper is preferably generally convex. The concave side can be used to rake debris out of the way behind the edge 63 as the concavity allows an area for the scraped debris 13 to accumulate. The convex side can be used to push debris out of the way or to allow it to pass over the side. In this regard, the scraper 60 is useful in a wide variety of scraping environments. An interior 64 can be provided. The scraper 60 can be transparent or translucent. In one embodiment, the scraper 60 is made of plastic. The scraper 60 has a base that is received within the body 30 of the tool 20 at end 31.

A light emitting device 70 (or simply, light), which is selectably turned on and off by a light control 71, is provided at or near the second end 32 either behind or within the scraper 60. One preferred type of light 70 is a LED. Yet, it is appreciated that other types of lights can be used without departing from the broad aspects of the present invention. The light 70 shines through or is diffused through the scraper 60. In this regard, the entire externally viewable surface of the scraper 60 is preferably illuminated (including the edge 63) as light passes there through.

Figure 4:
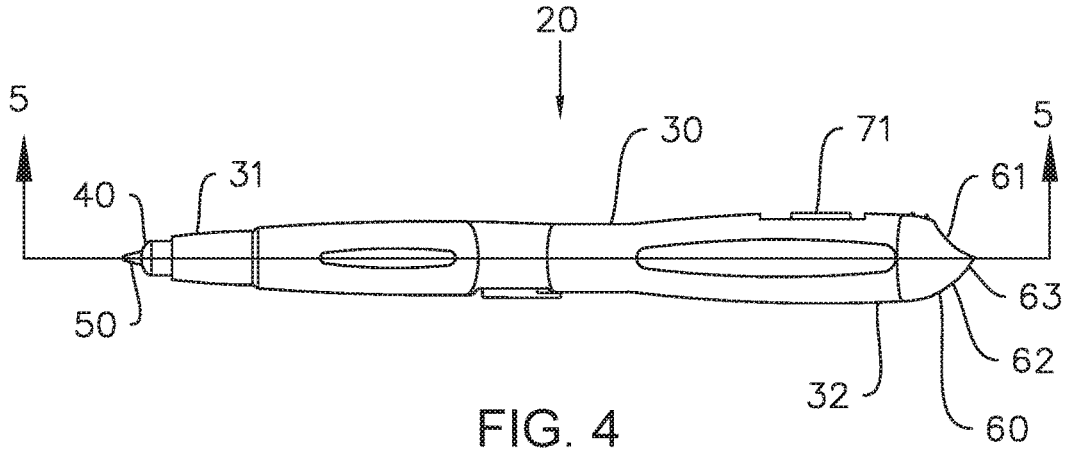
FIG. 4 is a side view of the embodiment illustrated in FIG. 1.
Figure 5:
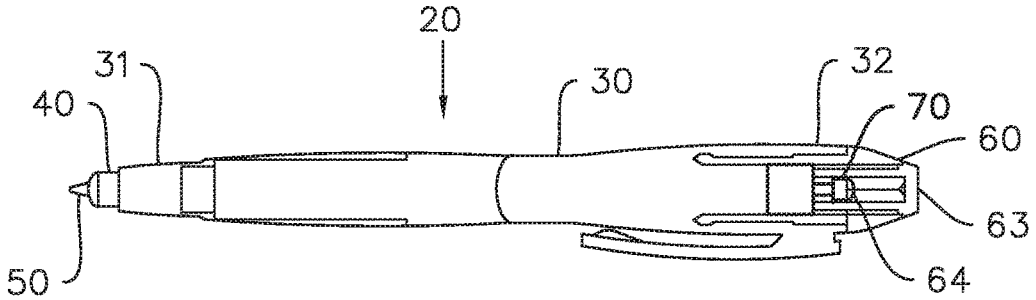
FIG. 5 is a cross-sectional taken along line 5-5 in FIG. 4.
Figure 6:
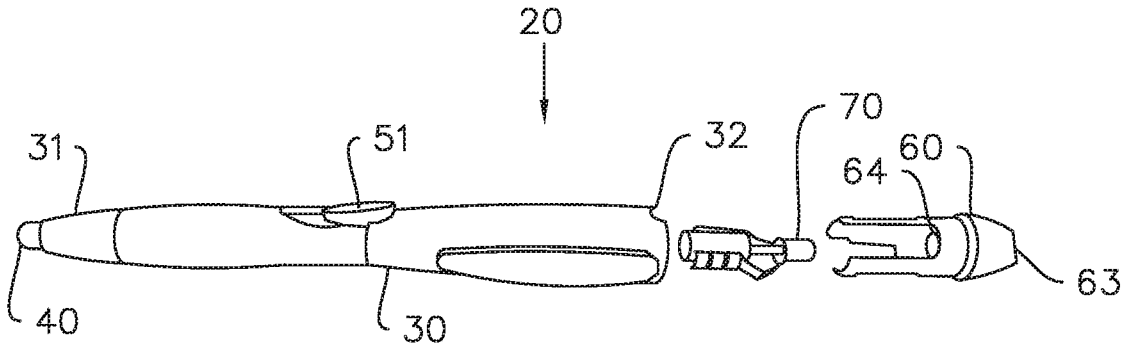
FIG. 6 is an exploded side view of the embodiment illustrated in FIG. 1.

Looking now at FIG. 4-6, it is seen that the light 70 is shown in relation to the scraper 60. In the preferred embodiment, light 70 is housed within the interior 64 of the scraper 60 between sides 61 and 62 and is located near the edge 63. The light can be powered by one or more batteries housed within the base of the scraper, which is received within the interior of the tool 20. Electric leads are connected to the light emitting device and to the batteries to complete an electric circuit upon operation of the light control 71.

Figure 7:
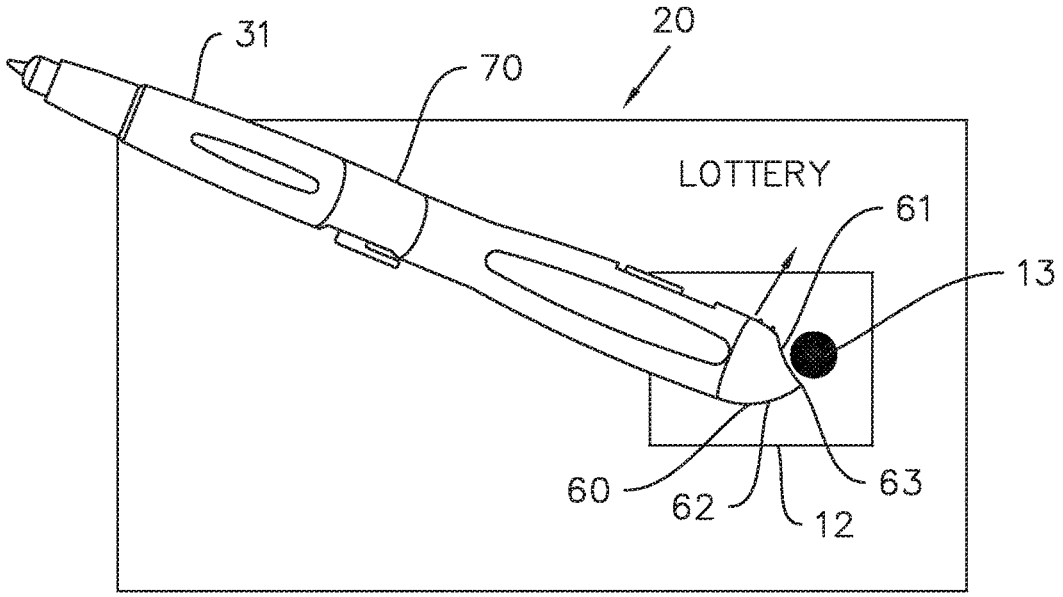
FIG. 7 is a view showing the tool of the present invention in use as a scraper.

Looking now at FIG. 7, the tool 20 is shown during one intended use wherein the scraper 60 is used to scrape a coating 12 from a surface 11 of an object 10. Debris 13 can accumulate at the concave face of side 61 when side 61 is the leading side in front of the edge 63. This advantageously allows the debris 13 room to accumulate as it is removed by the scraper 60.

Figure 8:
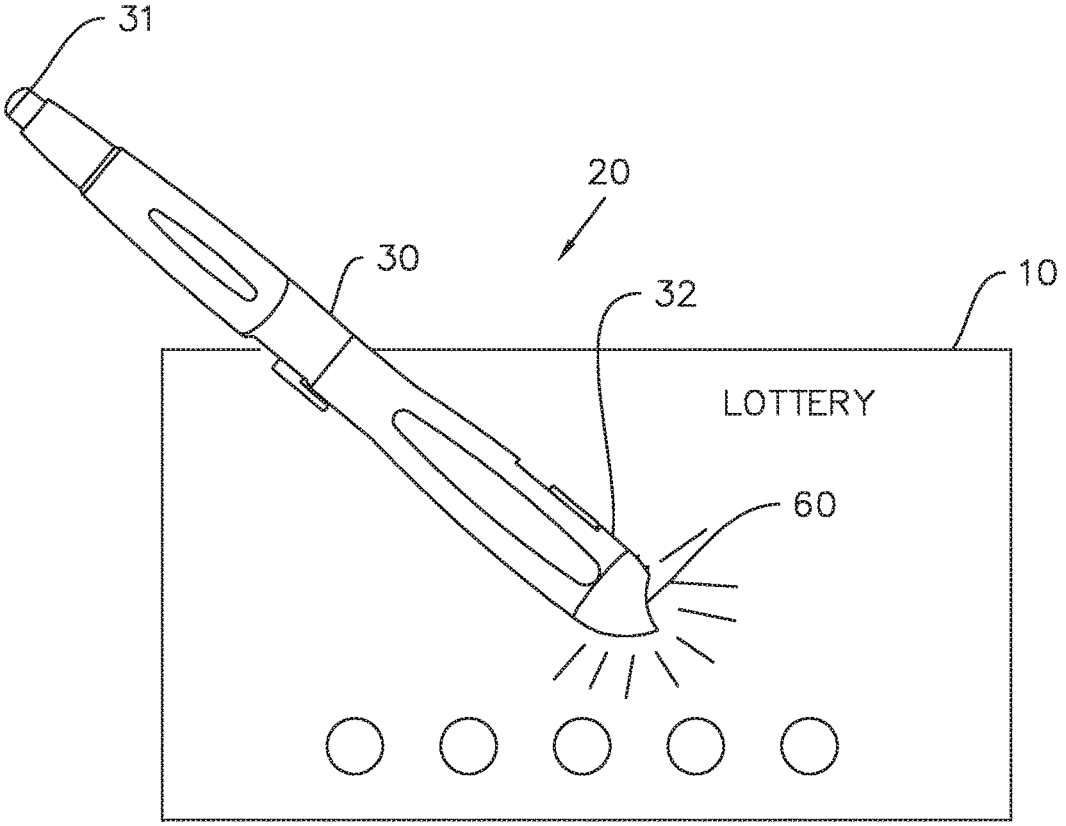

Looking now at FIG. 8, it is seen that the light 70 can be useful for illuminating the surface 11 of the object 10. Given that the edge 63 of the scraper is illuminated, light can be directed at the exact spot where the edge 63 is being used. Light is also directed radially from the scraper 60 in 360 degrees, insuring that the areas immediately adjacent the scraping location are also illuminated. Still further, the illumination is provided regardless of the orientation of the tool 20 relative to the object 10. Still further, it is appreciated that no shadows are created at or adjacent the scraper as light is emitted from the scraper sides 61 and 62, and from the scraper edge 63.

Figure 9:
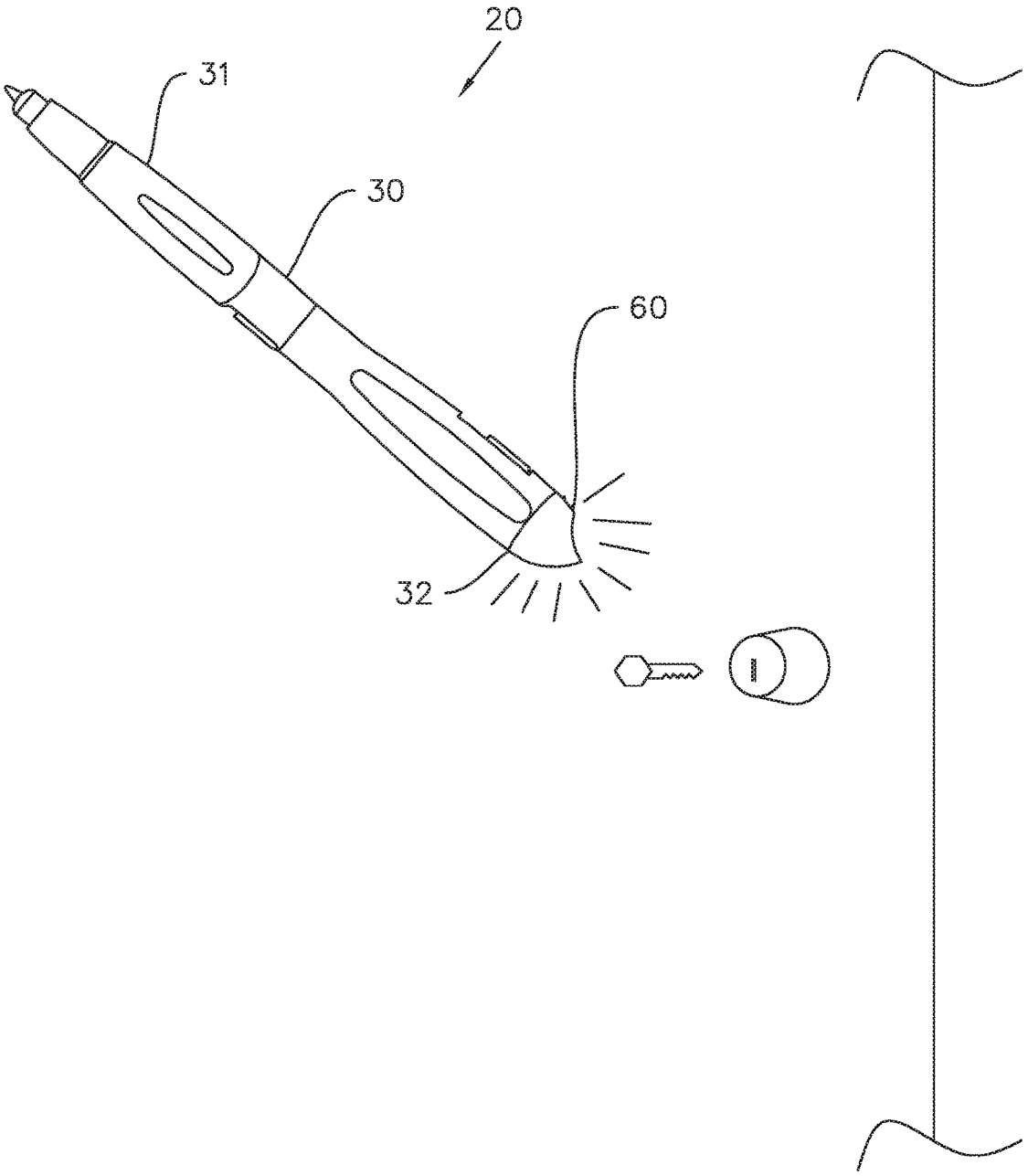
FIG. 9 is a view showing the tool of the present invention in use as a light.

Looking now to FIG. 9, it is seen that the present invention is being used generally as a light source. In the illustrated example, the light emitting device causes light to project from the tool whereby a keyhole of a lock can be illuminated. It is appreciated that other uses are possible and the illustrated example is merely one possibility.

Figure 10:
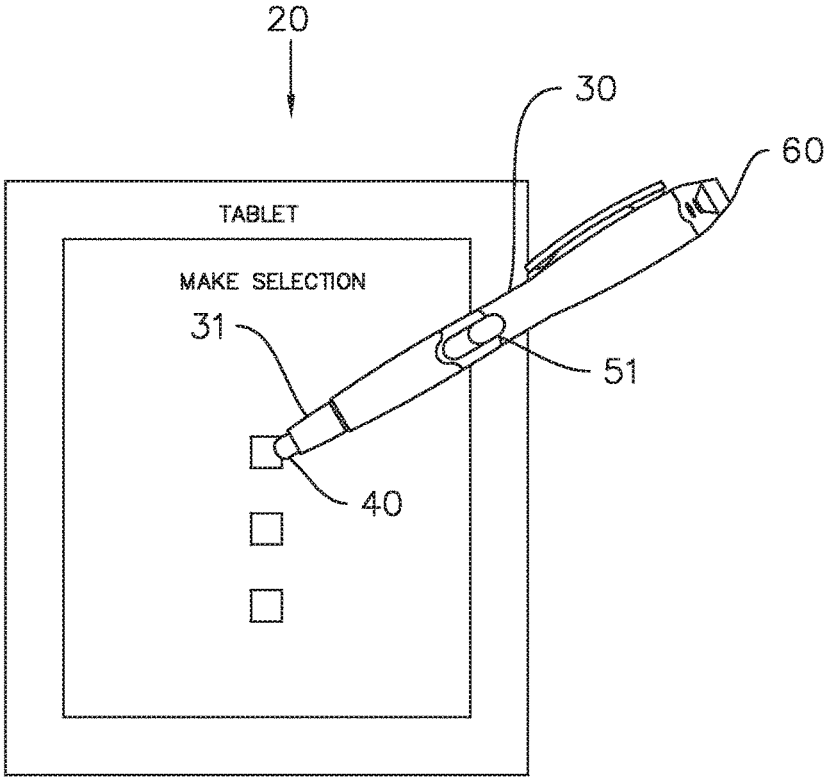
FIG. 10 is a view showing the tool of the present invention in use as a stylus.

Looking now to FIG. 10, it is seen that use of the stylus 40 is illustrated.

Figure 11:
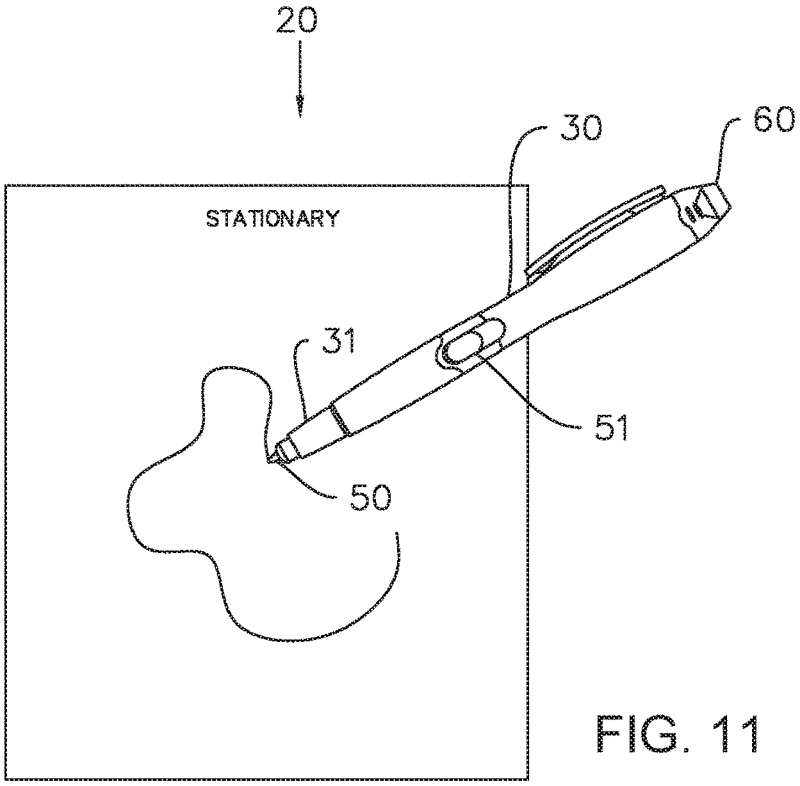
FIG. 11 is a view showing the tool of the present invention in use as a writing utensil.

Looking now to FIG. 11, it is seen that use of the writing element 50 is illustrated.

Hence, it is seen that four preferred functions of the present invention have been illustrated.

Thus it is apparent that there has been provided, in accordance with the invention, a scratching device with integrated light that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A tool comprising:
a first end;
a second end;
a scraper at said second end;
a light emitting device, said light emitting device selectably providing an amount of light that passes through said scraper; and
a stylus and a writing instrument at said first end, said writing instrument being selectably deployable through said stylus.

2. The tool of claim 1 wherein said light emitting device is at said second end.

3. The tool of claim 2 wherein said light emitting device is located within said scraper.

4. The tool of claim 3 wherein said amount of light is diffused by said scraper.

5. The tool of claim 4 wherein said amount of light is diffused radially 360 degrees through said scraper.

6. The tool of claim 4 wherein said scraper has an edge, said edge being illuminated by said light emitting device.

7. The tool of claim 6 further comprising a light control to selectably turn on and off said light emitting device.

8. The tool of claim 1 wherein:
said scraper has a first side and a second side;
said first side is convex; and
said second side is concave.

9. A tool comprising:
a body with a first end and a second end;
a stylus at said first end;
a pen at said first end;
a scraper at said second end; and
a light at said second end,
wherein said light selectably emits an amount of light through said scraper.

10. The tool of claim 9 wherein said scraper comprises an edge, said edge being illuminated when said light selectably emit an amount of light.

11. The tool of claim 10 wherein said amount of light is emitted radially 360 degrees through said scraper.

12. The tool of claim 9 wherein:
said scraper has a first side and a second side;
said first side is convex; and
said second side is concave.

13. A tool comprising:
a body with a first end and a second end;
a scraper at said second end, said scraper having an edge, said edge being selectably illuminated; and a stylus and a writing instrument at said first end, said writing instrument being selectably deployable through said stylus.

14. The tool of claim 13 comprising a light emitting device to selectably illuminate said edge.

15. The tool of claim 14 wherein said light emitting device is located within said scraper and selectably emits an amount of light.

16. The tool of claim 15 wherein said amount of light is emitted radially 360 degrees through said scraper.

17. The tool of claim 13 wherein:

said scraper has a first side and a second side;

said first side is convex; and said second side is concave.

* * * * *